US005691501A

United States Patent [19]

Gilbert

[11] Patent Number: 5,691,501

[45] Date of Patent: Nov. 25, 1997

[54] LONG-RANGE NONLETHAL BULLET

[75] Inventor: Raine M. Gilbert, Vienna, Va.

[73] Assignee: The United States of America as represented by the Secretary of the Army, Washington, D.C.

[21] Appl. No.: 687,070

[22] Filed: Jul. 8, 1996

[51] Int. Cl.[6] ..... F42B 8/14

[52] U.S. Cl. ..... 102/444; 102/502; 102/529

[58] Field of Search ..... 102/395, 430, 102/439, 444, 446, 447, 501, 502, 506, 507–510, 513–517, 529, 498

[56] References Cited

U.S. PATENT DOCUMENTS

| | | | |
|---|---|---|---|
| 3,732,821 | 5/1973 | Royer . | |
| 3,834,311 | 9/1974 | Mawhinney et al. | 102/439 |
| 3,952,662 | 4/1976 | Greenlees . | |
| 3,982,489 | 9/1976 | Flatau et al. . | |
| 4,996,924 | 3/1991 | McClain | 102/501 |
| 5,009,164 | 4/1991 | Grinberg | 102/502 |
| 5,016,536 | 5/1991 | Brighton . | |
| 5,121,692 | 6/1992 | DiCarlo . | |
| 5,221,809 | 6/1993 | Cuadros . | |

FOREIGN PATENT DOCUMENTS

| | | | |
|---|---|---|---|
| 2516579 | 10/1976 | Germany | 102/502 |
| 3819251 | 12/1989 | Germany | 102/506 |

*Primary Examiner*—Harold J. Tudor

*Attorney, Agent, or Firm*—Freda L. Krosnick; William E. Eshelman

[57] ABSTRACT

A nonlethal long-range bullet designed to be fired from a conventional high-powered rifle or pistol spreads apart on impact, thereby delivering a nonlethal blow to the target. Prior to impact, the inventive bullet maintains its aerodynamic shape. The bullet includes a front section in a forward portion of the bullet, the front section having a tail that extends to a rear portion of the bullet; a solid section in the rear portion of the bullet, the solid section including most of the mass of the bullet and being substantially disposed around the tail; at least two longitudinal scribe lines that extend along the front section and the tail; and at least another two longitudinal scribe lines that extends along the solid section and are aligned with the at least two longitudinal scribe lines, wherein depths of the at least two and at least another two longitudinal scribe lines are such that the bullet maintains shape integrity during flight while readily deploying into a flattened shape upon impact.

19 Claims, 3 Drawing Sheets

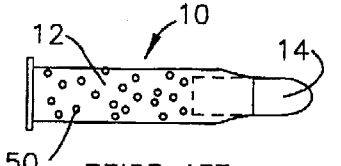
PRIOR ART
FIG. 1
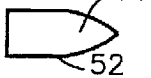
PRIOR ART
FIG. 2(A)
PRIOR ART
FIG. 2(B)
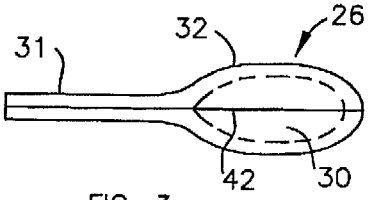
FIG. 3
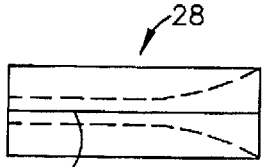
FIG. 4
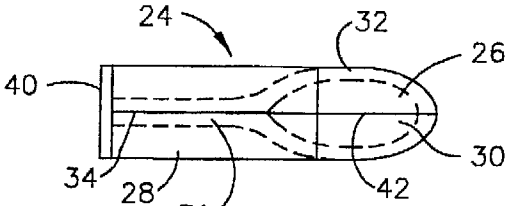
FIG. 5
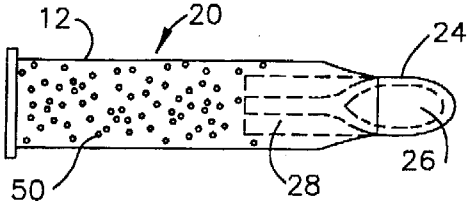
FIG. 6
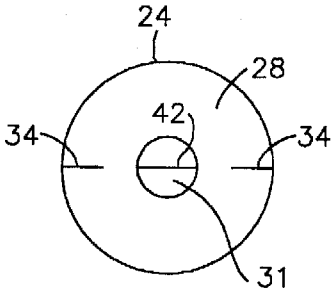
FIG. 7
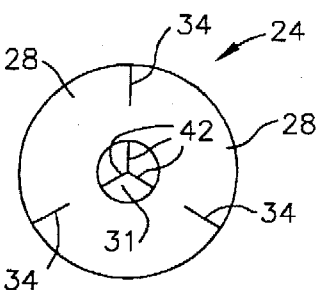
FIG. 8
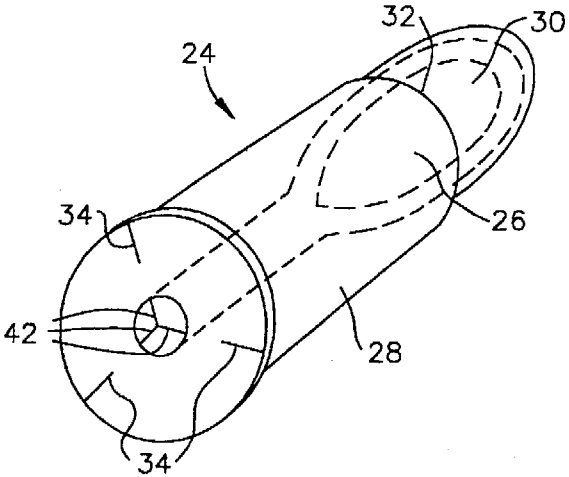
FIG. 9

LONG-RANGE NONLETHAL BULLET

BACKGROUND OF THE INVENTION

The invention relates in general to nonlethal projectiles and, in particular, to long-range nonlethal bullets.

There are occasions and circumstances, for example, personal self-defense, home self-defense, police uses and military uses, where society generally deems it preferable to achieve the disabling of an individual without inflicting a likely lethal blow. It is to such applications that the present invention is primarily directed.

Prior nonlethal projectiles are characteristically inaccurate and short range, e.g., up to 100 meters. The present invention is a nonlethal bullet designed to deliver incapacitating shock at long range, e.g., 500 meters or more. Thus, an advantage of the present invention is that it can deliver a nonlethal bullet while maintaining a safe separation distance between the user and a threatening individual.

SUMMARY OF THE INVENTION

It is an object of the invention to provide an improved nonlethal bullet.

It is another object of the invention to provide a nonlethal bullet that can be delivered at long ranges.

These and other objects of the invention are achieved by a bullet, comprising a front section in a forward portion of the bullet, the front section including a tail that extends to a rear portion of the bullet; a solid section in the rear portion of the bullet, the solid section being substantially disposed around the tail; at least two longitudinal scribe lines that extend along the front section and the tail; and at least another two longitudinal scribe lines that extend along the solid section and are respectively aligned with the at least two longitudinal scribe lines, wherein depths of the at least two and at least another two longitudinal scribe lines are such that the bullet maintains shape integrity during flight while readily deploying into a flattened shape upon impact.

Another aspect of the invention is a method of deploying the above-described bullet comprising projecting the bullet toward a target; impacting the front section of the bullet on the target; collapsing the front section by tearing along the at least two longitudinal scribe lines; and deforming the solid section into an at least two-fingered shape by tearing along the at least another two longitudinal scribe lines, thereby spreading an impact momentum over a surface area larger than an impact area of a standard bullet.

Further objects, features and advantages of the invention will become apparent from the following detailed description taken in conjunction with the drawings.

BRIEF DESCRIPTION OF THE DRAWINGS

FIG. 1 shows a prior art cartridge;

FIGS. 2(*a*) and 2(*b*) show a prior art bullet;

FIG. 3 is a side view of the front section of the inventive bullet;

FIG. 4 is a side view of the solid section of the inventive bullet;

FIG. 5 is a side view of the inventive bullet;

FIG. 6 is a side view of a cartridge including the inventive bullet;

FIG. 7 is a rear view of the inventive bullet;

FIG. 8 is a rear view of the inventive bullet;

FIG. 9 is a perspective view of the inventive bullet;

DETAILED DESCRIPTION OF THE PREFERRED EMBODIMENTS

Figure 13:
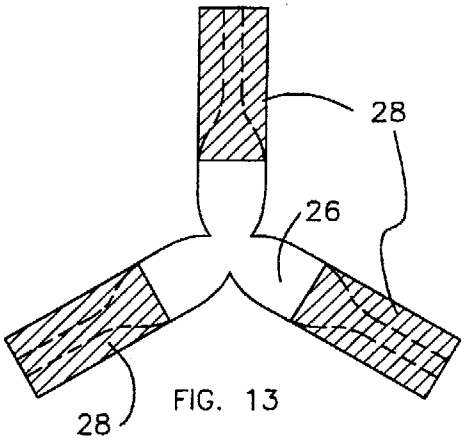
FIG. 13 is a front view of a flattened bullet.

The present invention is a nonlethal bullet designed to be fired from a conventional high-powered rifle or pistol. The nonlethal bullet spreads apart on impact, thereby delivering a nonlethal blow to the target. Prior to impact, the inventive bullet maintains its aerodynamic shape.

FIG. 1 shows a conventional cartridge 10 including a casing 12, propellant 50 and a bullet 14. FIG. 2(*a*) shows the conventional bullet 14 and FIG. 2(*b*) shows the lead core of the bullet 14 covered by an optional metal jacket 52.

FIG. 6 shows a cartridge 20 of the present invention, including a conventional casing 12, propellant 50 and a long-range nonlethal bullet 24. To avoid modifications to conventional weapons, the bullet 24 may be used with conventional casings 12 of various rifle or pistol calibers, for example 0.25 M16, 0.30, 0.30–06, 0.357 magnum, 0.44 magnum, or 0.45. To maximize the long-range advantage of the invention, the cartridge 20 would preferably be used in a rifle.

Figure 12:
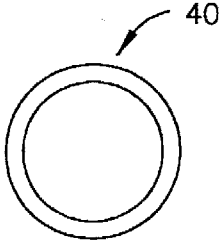
FIG. 12 is an end view of a ring.
Figure 17:
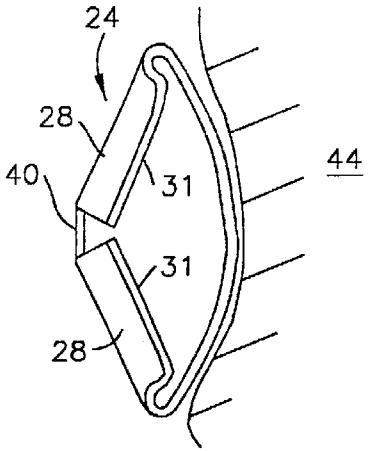
FIGS. 15–18 show the impact sequence of the inventive bullet.
Figure 18:
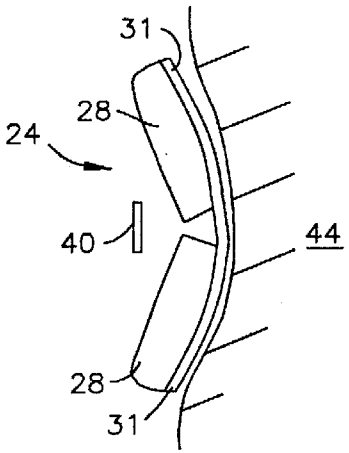

FIG. 5 shows the bullet 24 of the invention. The bullet 24 includes a thin-walled front section 26 which defines a hollow space 30 and a tail 31. Bullet 24 also includes a solid section 28 generally disposed around the tail 31. The solid section 28 preferably includes most of the mass of the bullet 24. Bullet 24 may optionally include a ring 40 (see FIG. 12 also) which is further discussed below. The solid section 28 is attached to the front section 26 by, for example , casting, bonding or glueing.

As shown in FIGS. 3 and 4, both front section 26 and solid section 28 include at least one longitudinal scribe line 35,42 respectively. Scribe lines 34 and 42 are aligned with each other (see FIGS. 5,7,8,9).

Thin-wall 32 (see FIGS. 3,9) in front section 26 is preferably on the order of 20 mils thick. The front section 26 is preferably made of a low density, readily deformable material, such as aluminum.

The solid section 28 of bullet 24 is made of conventional bullet material, e.g., lead. The total length of bullet 24 is of the order of, for example, 1.5–2 times the length of the standard (conventional caliber) pistol bullet and, for example, 2–3 times the length of the standard rifle bullet. The mass of bullet 24 is of the order of, for example, 1 to 2 times the mass of the standard pistol bullet and about, for example, 2 times the mass of the standard rifle bullet.

FIGS. 7 and 8 are rear views of bullet 24. FIG. 7 shows two longitudinal scribe lines 34 in solid section 28 aligned with two longitudinal scribe lines 42 in front section 26. FIGS. 8 and 9 similarly shows three longitudinal scribe lines 34 aligned with three scribe lines 42. Additional aligned longitudinal scribe lines 34,42 may be added.

Figure 10:
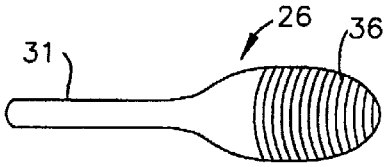
FIGS. 10 and 11 are side views of the front section of the inventive bullet.
Figure 11:
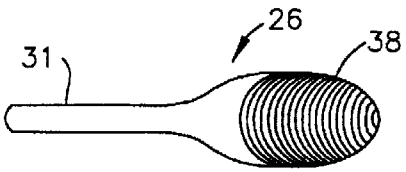

FIG. 10 shows concentric circular external ribs 36 formed on the surface of front section 26. FIG. 11 shows helical external ribs 38 on the surface of front section 26.

Figure 14:
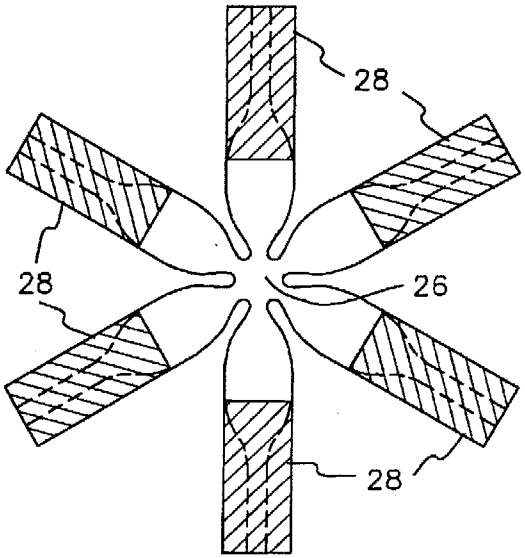
FIG. 14 is a front view of a flattened bullet.
Figure 15:
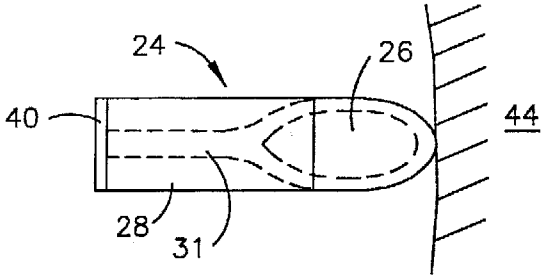
Figure 16:
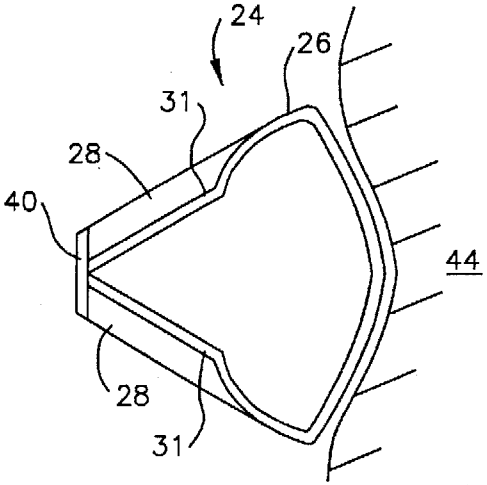

FIGS. 15–18 show the impact sequence of a bullet 24 against a target 44. FIG. 15 shows the bullet 24 as it initially contacts target 44. As seen in FIG. 16, on impact, the front section 26 collapses, tearing along longitudinal scribe lines 42 and deforming into a flattened multi-fingered shape, as shown in FIGS. 13 and 14. The shape of FIG. 13 results when there are three scribe lines 34 aligned with three scribe lines 42. The shape of FIG. 14 results when there are six scribe lines 34 aligned with six scribe lines 42. As the number of scribe lines is varied, the resulting shape will vary.

The deformation of the front section 26 acts to lever apart the solid section 28 along the longitudinal scribe lines 34. The leveraging forces are transmitted to the solid section 28 by the tail 31, which is a contiguous extension of the front section 26.

A ring 40 (FIGS. 5,12) may be used as a rotational pivot at the rear of the bullet 24 to further facilitate the outward flaring of the front end of the segments of the solid section 28. The outward flaring or deployment is designed to occur only at impact, so that the bullet 24 retains its aerodynamic (low-drag) shape, spin, and attitude during flight. Delaying deployment until impact assures high accuracy even at long range, as well as long range shock effect. The longitudinal scribe lines (cuts) 34,42 are to be shallow enough that shape integrity is maintained against centrifugal spin forces during flight, but deep enough so that the bullet 24 deploys readily into the flattened shape on impact.

Deployment may be further facilitated by the concentric circular ribbing 36 (FIG. 10) of the front section 26, or a spiral concentric rib 38 (FIG. 11). The ribs 36,38 lower resistance to compaction on impact without a commensurate reduction in the resistance of the front section 26 to centrifugal forces.

The result of the flattening out of the bullet 24 is that impact momentum is spread over a target surface area many times larger than the impact area of a standard bullet 14, thereby reducing impact pressure on the target surface and, therefore, reducing the likelihood of penetration and lethality.

The inventive bullet 24 is to project out from a standard cartridge casing 12 the same distance as a standard bullet 14, thereby keeping the bullet 24 and cartridge 20 compatible with existing firearms. The excess length of the bullet 24 extends rearward into the powder reservoir of the casing 12. The extra displacement of the bullet 24 into the powder reservoir reduces the amount of propellant that the cartridge 20 can accommodate. The reduction in the amount of propellant is acceptable because: 1) the design objective is momentum transfer and incapacitating shock generation at the target surface, both of which tend to be increased linearly by the extra mass of the bullet 24, thereby offsetting the effect of a lower velocity; and 2) shock effects are increased when the bullet 24 is stopped more quickly, that is, in a shorter distance. With the bullet 24, the stopping distance is preferably 1–3 inches of surface displacement as compared to perhaps 5–7 inches of penetration into the target by a standard bullet 14.

As an example, if the inventive cartridge 20 holds ⅔ of a standard powder load, a zero-order estimate gives the nonlethal bullet 24 an imparted kinetic energy equal to ⅔ that of the standard bullet 14. With ⅔ of the energy and twice the bullet mass, the bullet 24 would have about ⅗ the velocity and almost ⅘ of the momentum of the faster, lighter, standard bullet 14. Depending on the desired margin of safety against undesired penetration or lethal shock trauma, the powder load could be further reduced at the expense of range and accuracy, or cartridges could be produced with a range of powder loading to accommodate a variety of ranges and tactical situations. Bullet mass, length, number of segments (e.g., from as few as 2 to as many as 6), and other design specifics may be varied, with the final designs based on specific tactical effects desired, effects modeling, testing, and costs.

The utility of the long-range nonlethal bullet 24 would be greatest for military and civilian authorities in circumstances where temporary incapacitation of one or more individuals is the desired objective and large standoff distances are needed, either because the target is believed to be armed, or because the element of surprise is important.

While the invention has been described with reference to certain preferred embodiments, numerous changes, alterations and modifications to the described embodiments are possible without departing from the spirit and scope of the invention, as defined in the appended claims, and equivalents thereof.

What is claimed is:

1. A bullet, comprising:

a front section in a forward portion of the bullet, the front section including a tail that extends to a rear portion of the bullet, a hollow space located within a forward portion of the front section;

a solid section in the rear portion of the bullet, the solid section being substantially disposed around the tail;

at least two longitudinal scribe lines that extend along the front section and the tail; and at least another two longitudinal scribe lines that extend along the solid section and are respectively aligned with the at least two longitudinal scribe lines, wherein depths of the at least two and at least another two longitudinal scribe lines are such that the bullet maintains shape integrity during flight while readily deploying into a flattened shape upon impact.

2. The bullet of claim 1, further comprising at least one externally projecting concentric circular rib in the front section.

3. The bullet of claim 1, further comprising spiral concentric scribing on an exterior of the front section.

4. The bullet of claim 1, further comprising a pivot ring located at a rear end of the solid section.

5. The bullet of claim 1, further comprising a third longitudinal scribe line that extends along the front section and the tail, and a third longitudinal scribe line that extends along the solid section and is aligned with the third longitudinal scribe line that extends along the front section and the tail.

6. The bullet of claim 5, further comprising a fourth longitudinal scribe line that extends along the front section and the tail,.and a fourth longitudinal scribe line that extends along the solid section and is aligned with the fourth longitudinal scribe line that extends along the front section and the tail.

7. The bullet of claim 6, further comprising a fifth longitudinal scribe line that extends along the front section and the tail, and a fifth longitudinal scribe line that extends along the solid section and is aligned with the fifth longitudinal scribe line that extends along the front section and the tail.

8. The bullet of claim 7, further comprising a sixth longitudinal scribe line that extends along the front section and the tail, and a sixth longitudinal scribe line that extends along the solid section and is aligned with the sixth longitudinal scribe line that extends along the front section and the tail.

9. The bullet of claim 8, further comprising a seventh longitudinal scribe line that extends along the front section and the tail, and a seventh longitudinal scribe line that extends along the solid section and is aligned with the seventh longitudinal scribe line that extends along the front section and the tail.

10. A cartridge, comprising:

a cartridge casing; and a bullet, the bullet comprising;

a front section in a forward portion of the bullet, the front section including a tail that extends to a rear portion of the bullet, a hollow space located within a forward portion of the front section;

a solid section in the rear portion of the bullet, the solid section being substantially disposed around the tail;

at least two longitudinal scribe lines that extend along the front section and the tail; and at least another two longitudinal scribe lines that extend along the solid section and are respectively aligned with the at least two longitudinal scribe lines, wherein depths of the at least two and at least another two longitudinal scribe lines are such that the bullet maintains shape integrity during flight while readily deploying into a flattened shape upon impact.

11. The cartridge of claim 10, wherein the bullet further comprises at least one outwardly projecting concentric circular rib in the front section.

12. The cartridge of claim 10, wherein the bullet further comprises spiral concentric scribing on the front section.

13. The cartridge of claim 10, wherein the bullet further comprises a pivot ring located at a rear end of the solid section.

14. The cartridge of claim 10, wherein the bullet further comprises a third longitudinal scribe line that extends along the front section and the tail, and a third longitudinal scribe line that extends along the solid section and is aligned with the third longitudinal scribe line that extends along the front section and the tail.

15. The cartridge of claim 14, wherein the bullet further comprises a fourth longitudinal scribe line that extends along the front section and the tail, and a fourth longitudinal scribe line that extends along the solid section and is aligned with the fourth longitudinal scribe line that extends along the front section and the tail.

16. The cartridge of claim 15, wherein the bullet further comprises a fifth longitudinal scribe line that extends along the front section and the tail, and a fifth longitudinal scribe line that extends along the solid section and is aligned with the fifth longitudinal scribe line that extends along the front section and the tail.

17. The cartridge of claim 16, wherein the bullet further comprises a sixth longitudinal scribe line that extends along the front section and the tail, and a sixth longitudinal scribe line that extends along the solid section and is aligned with the sixth longitudinal scribe line that extends along the front section and the tail.

18. The cartridge of claim 17, wherein the bullet further comprises a seventh longitudinal scribe line that extends along the front section and the tail, and a seventh longitudinal scribe line that extends along the solid section and is aligned with the seventh longitudinal scribe line that extends along the front section and the tail.

19. A method of deploying the bullet of claim 1, comprising:

projecting the bullet toward a target;

impacting the front section of the bullet on the target;

collapsing the front section by tearing along the at least two longitudinal scribe lines; and deforming the solid section into an at least two-fingered shape by tearing along the at least another two longitudinal scribe lines, thereby spreading an impact momentum over a surface area larger than an impact area of a standard bullet.

* * * * *